US005101530A

United States Patent [19]

Hansen et al.

[11] Patent Number: 5,101,530

[45] Date of Patent: Apr. 7, 1992

[54] SQUEEGEE

[75] Inventors: Alan M. Hansen; Sandra J. Hansen, both of Lake Oswego; Christopher G. Alviar, Portland, all of Oreg.; Paul E. Furner, Logan, Utah; Terrence K. Jones, Portland, Oreg.; David R. Knaub, Portland, Oreg.; Sohrab Vossoughi, Portland, Oreg.

[73] Assignee: Hanco, Inc., Lake Oswego, Oreg.

[21] Appl. No.: 491,445

[22] Filed: Mar. 6, 1990

[51] Int. Cl.[5] ..... A47L 13/11

[52] U.S. Cl. ..... 15/245; 15/250.41; 30/172

[58] Field of Search ..... 15/245, 250.36, 250.41, 15/236.01, 236.02, 236.06, 236.08; 30/172, 329

[56] References Cited

U.S. PATENT DOCUMENTS

| | | | |
|---|---|---|---|
| 1,520,045 | 12/1924 | Winiarski | 15/245 |
| 1,647,513 | 11/1927 | Dutton, Jr. | 15/245 |
| 4,075,730 | 2/1978 | Siemund | 15/245 |

FOREIGN PATENT DOCUMENTS

| | | | |
|---|---|---|---|
| 288402 | 4/1928 | United Kingdom | 15/245 |
| 919745 | 2/1963 | United Kingdom | 15/245 |

*Primary Examiner*—Edward L. Roberts
*Attorney, Agent, or Firm*—Edward B. Watters

[57] ABSTRACT

An improved, light-weight squeegee suitable for use in and around the home for cleaning and drying shower and tub enclosures, windows, and spa decks, or autos and boat decks. The squeegee is constructed without metal parts that could scratch glass, ceramic and painted surfaces or that could corrode and stain such surfaces. A cylindrical handle holds dual S-shaped blades, which extend along the handle and beyond one end of the handle to facilitate cleaning in tight spaces. The unitary blades are coextruded from thermoplastics having different hardnesses, the roots of the blades held in the slotted handle being stiff, while the extended portions of the blades used for wiping surfaces are relatively flexible. The compact size and the integral handle parallel with the blades allows the user to maneuver the squeegee efficiently in the narrow confines of glass enclosures.

29 Claims, 2 Drawing Sheets

SQUEEGEE

BACKGROUND OF THE INVENTION

This invention relates generally to cleaning implements, and more particularly to an improved squeegee useful for cleaning generally planar surfaces such as glass and plastic panels and enclosures, and windowpanes.

Glass and tile surfaces of enclosures for baths and showers can be cleaned conveniently and simply by using a squeegee immediately after bathing to remove water that clings to the surfaces. Conventional squeegees, which generally have a handle perpendicular to the blade, are cumbersome and awkward to use in and around the home, particularly in a shower or bath enclosure, and when stored inside the enclosure, can be an annoyance, getting in the way of a bather. Furthermore, most conventional squeegees employ metal parts such as blade holders and handle supports, and such metal parts can scratch glass, tile and painted surfaces, or stain the surfaces when the metal parts oxidize. Conventional squeegees with projecting handles and metal parts are likewise not suited for use in and around autos and boats.

It is therefore a principal object of the present invention to provide an improved squeegee.

It is a more particular object of the invention to provide an improved squeegee which is ergonomically suited for use and storage in confined spaces such as a bath or shower enclosure.

Another object of the invention is to provide an improved squeegee having no metal components that can stain or damage glass, ceramic and painted surfaces.

Another object of the invention is to provide an improved squeegee useful in a shop or light industrial environment for cleaning work surfaces.

It is another object of the invention to provide an improved squeegee useful for cleaning sensitive painted surfaces such as those of automobiles and boat decks.

Another object of the invention is to provide an improved squeegee that floats on water.

Yet another object of the invention is to provide an improved squeegee adapted for grasping with the blade essentially parallel to the arm of the user.

SUMMARY OF THE INVENTION

These and other objects are achieved according to the instant invention by a squeegee having an elongate handle and a unitary blade parallel with and held in an arcuate slot of the handle. In a preferred embodiment of the invention, the blade is coextruded from two formulations of thermoplastic with different degrees of hardness, the root portion of the blade being stiff to facilitate its being held in the arcuate slot, while the extended portion of the blade used for wiping surfaces is relatively flexible. In another embodiment of the invention, the blade extends longitudinally beyond one end of the handle to facilitate cleaning surfaces in tight spaces such as corners. In another embodiment of the invention, an end of the squeegee handle employs a flat surface perpendicular to the longitudinal axis of the handle, the end of the blade being coplanar with the flat surface so that the squeegee can be stored vertically resting on the flat surface with the blade serving to buttress the upright handle. In another embodiment of the invention, the handle is provided with a contoured region serving as a handgrip.

BRIEF DESCRIPTION OF THE DRAWING

While the invention is set forth with particularity in the appended claims, other objects, features, advantages and the method of operation of the invention will become more apparent, and the invention will best be understood by referring to the following detailed description in conjunction with the accompanying drawing, wherein like reference characters denote like elements:

DESCRIPTION OF THE PREFERRED EMBODIMENT

Figure 1:
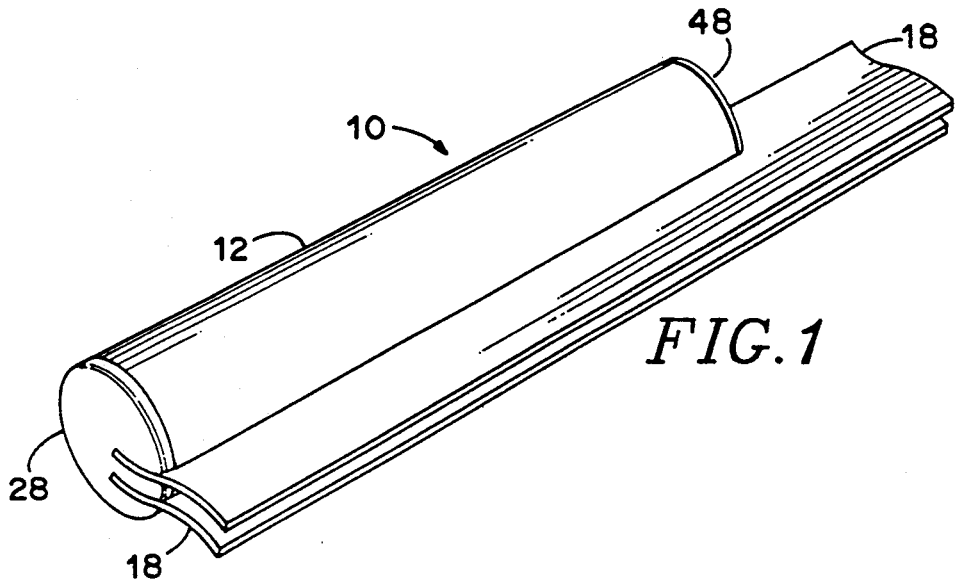
FIG. 1 is a pictorial view of a squeegee in accordance with the present invention.
Figure 2:
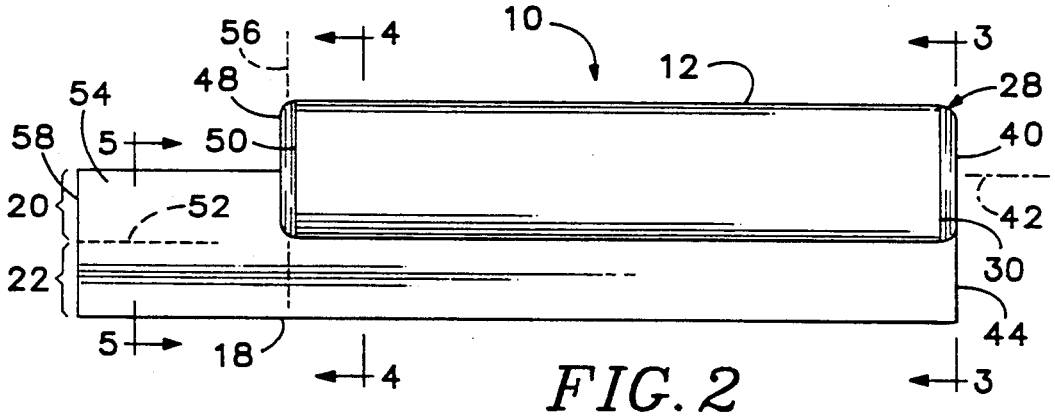
FIG. 2 is a plan view of the squeegee of FIG. 1.

Referring now to the various views of the drawing for a more detailed description of the components, materials, construction, function, operation and other features of the instant invention by characters of reference, FIGS. 1-5 illustrate a squeegee 10 having a handle 12 in the general form of a hollow cylinder. The handle 12 is fashioned with an interiorly disposed chine 14 in which a pair of mutually parallel slots 16 are formed integrally with the handle 12 and spaced apart from each other, the slots 16 extending longitudinally the length of the handle 12. The cylindriform handle 12 can be circular in cross section as illustrated in FIGS. 1-4, or of other forms such as ellipsoid or generally triangular in cross section. The handle 12 is suitably made from a relatively light weight, solid material such as carbon fiber or aluminum. Preferably, the handle is injection molded from a thermoplastic material such as polyvinyl chloride (PVC), acrylonile-butadiene-styrene (ABS), Santoprene or polyamide, the preferred material being ABS. Injection molding is the preferred process utilized for forming the handle 12 from thermoplastic material; extrusion, however, is satisfactory for forming aluminum handles.

Figure 3:
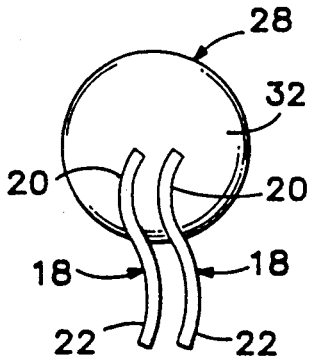
FIG. 3 is a view of the squeegee taken along lines 3—3 of FIG. 2.
Figure 4:
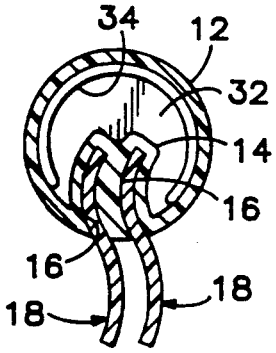
FIG. 4 is a section view taken along lines 4—4 of FIG. 2.
Figure 5:
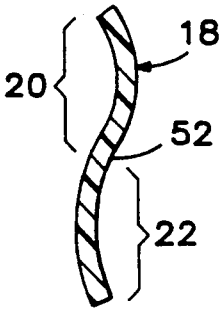
FIG. 5 is a section view of one squeegee blade taken along lines 5—5 of FIG. 2.

The squeegee 10 includes a pair of elongate blades 18, which is the preferred embodiment of the invention; it is understood, however, that only a single blade, or more than two blades may be employed. While the ensuing description may refer to a single one of like elements such as a blade or slot, it is understood for simplicity that the description applies as well to the like elements. The elongate blade 18 includes a root portion 20 and a working portion 22, the root portion 20 being seated in the slot 16 such that the working portion 22 of the blade projects from the slot 16 abaxially of handle. The slot 16 and the root portion 20 of the blades 18 are suitably arcuate in cross section as seen in FIGS. 3, 4 and 5, the curvature of the slot 16 and the root portion 20 preferably being irregular, as for example parabolic rather than circular, whereby the irregularity facilitates holding the root portion 20 of the blade 18 in the slot 16, after the blade is slipped longitudinally into the slot. The extended working portion 22 of the blade 12 curves oppositely of the root portion 20 to form a blade with an S-shaped cross section, which is the preferred embodiment, providing greater symmetry and balance of the squeegee than would a flat working portion or a blade continuously curved in the same direction.

Figure 6:
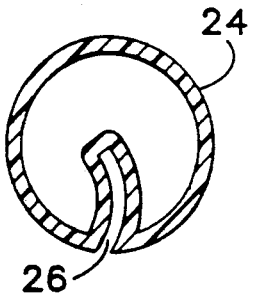
FIG. 6 illustrates in cross section an alternative embodiment of a squeegee handle according to the present invention.
Figure 7:
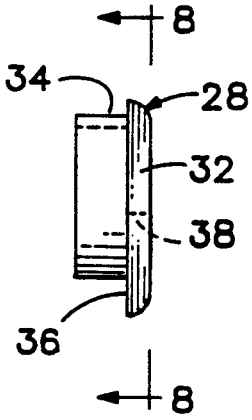
FIG. 7 illustrates an end cap of the squeegee of FIG. 2.
Figure 8:
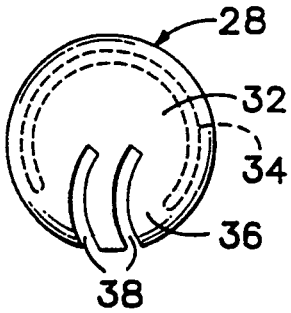
FIG. 8 is a section view taken along lines 8—8 of FIG. 7.

FIG. 6 illustrates an alternative embodiment of a handle 24 for a one-blade squeegee, the handle 24 having a single longitudinal slot 26 receiving a blade such as the blade 18 of FIG. 5.

Figure 9:
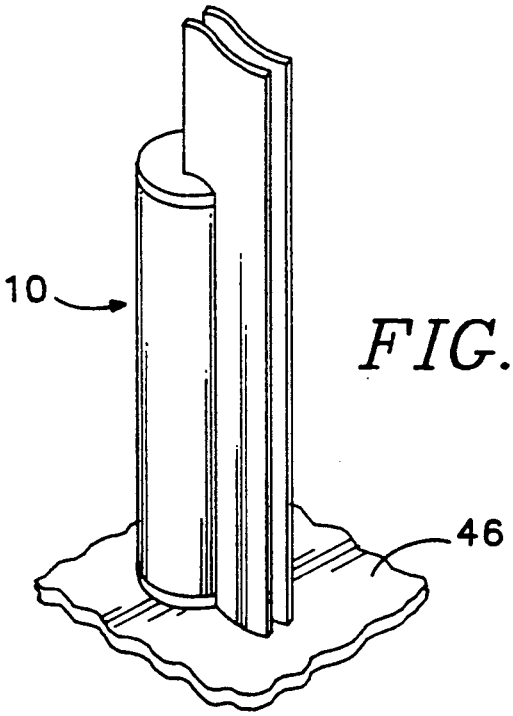
FIG. 9 is a pictorial view of a squeegee according to the present invention set in an upright position on a flat surface for storage.

Referring to FIGS. 1–4, 7 and 8, a slotted end cap 28 closes an end 30 of the cylindriform handle 12, and includes a planar closure 32 from which a flange 34 extends into the handle, the flange 34 having an outside diameter essentially the same as the inside diameter of the cylindriform handle 12, such that the flange 34 presses into the end of the handle 12. The flange 34 is discontinuous, having a gap or opening 36 into which the chine 14 of the handle 12 is received when the end cap 28 is installed on the handle. Slots 38 in the end cap 28 receive the blades 18 therein, the slots 38 having the same curvature as the slots 16 of the handle 12. Although the slots 38 of the end cap 28 are shown extending through the planar closure 32, the slots 38 suitably can extend only partly through the closure. However, in the preferred embodiment of the invention, the end cap 28 is provided with a flat surface 40 perpendicular to a longitudinal axis 42 of the handle, and the blade ends 44 are coplanar with the surface 40 so that the squeegee 10 can be set upright on a flat surface 46 as illustrated in FIG. 9, for storage in an out-of-way location such as a corner of a shower enclosure. Slots of the end cap 48 closing the opposite end 50 of the handle 12 are the mirror image of the slots 38 in the end cap 28. The end caps 28, 48 are made, as by injection molding, from a stiff, inflexible material such as polyamide or polyvinyl chloride, the preferred material being PVC.

The blades 18 extend longitudinally beyond one end 50 of the handle 12 a distance about one fourth the length of the handle. The extended blades, and a slight flexibility of the root portion of the blades as described below, facilitate cleaning in corners, on irregular surfaces and other areas that might be inaccessible due to the thickness of the handle 12.

Each of the blades 18 is coextruded as a unitary element from a suitable flexible or resilient thermoplastic material, the root portion 20 and the working portion 22 having different degrees of hardness, the root portion 20 of the blade being relatively inflexible while the working portion is relatively flexible, each with respect to the other, the interface 52 of the materials of different hardness bifurcating the blade longitudinally. The blades are suitably produced in automatic extrusion equipment, and coextruded as a unitary element having more than a single degree of hardness, thereby reducing the cost of tooling and production. A variety of plastic materials having moderate tensile strength and moderate to low tensile elastic modulus may be used for fabricating the blades 18. Suitable materials include PVC, Santoprene, and polyamide, the preferred material being PVC. The material utilized may be reinforced or filled to enhance one or more of its physical properties. The physical properties of the plastic material relating to tensile strength and resilience or elastic modulus largely determine the preference. For example, the root portion 20 of the blade should have sufficient tensile strength to be held securely in the arcuate slot 16 of the handle and the end-cap slots, and yet be sufficiently elastic to allow the extended end 54 of the root portion to flex slightly about an axis 56 through the blade at the end cap 48 perpendicular to the longitudinal axis 42 of the handle, while the working portion of the blade should be substantially more elastic to allow bending about a longitudinal axis 52 of the working portion 22 of the blade, when the squeegee is used for wiping a surface. Considering both cost and performance, the preferred coextrusion materials are, for the root portion of the blade, PVC 80 shore D rigid durometer, and for the working portion, PVC 60 shore A soft durometer. Slight flexibility of the extended end 54 of the root portion 20 of the blade is defined as approximately seven percent, e.g., five millimeters of lateral flexing at the distal end 58 of the root portion 20, when the blade extends longitudinally about seven centimeters beyond the end cap 48 of the handle 12 and reasonable lateral wiping force is applied to the blade end 54. The blades can be bonded into the handle with a suitable adhesive, although such bonding is not necessary. When the squeegee is assembled, the flanges 34 of the end caps 28, 48 are suitably bonded to the interior surface of the handle 12.

Figure 10:
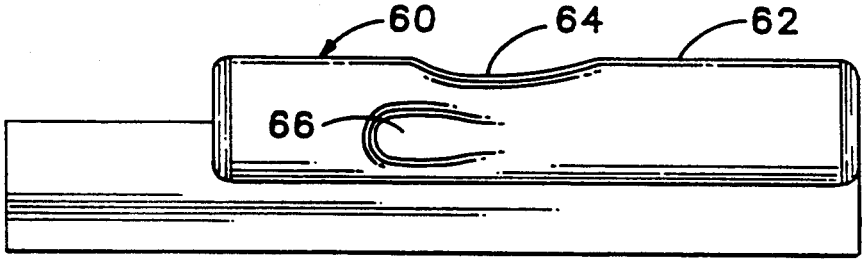
FIG. 10 illustrates an alternative embodiment of a squeegee according to the instant invention.

FIG. 10 illustrates an alternative embodiment of a squeegee 60 wherein the handle 62 is provided with a contoured handgrip including a first depression 64 shaped to fit fingers gripping the handle and the web between the index finger and thumb, and a second depression 66 shaped to receive the thumb, the contoured handgrip being essentially centrally located on the handle 62 in the position where an uncontoured handle would normally be grasped. The handle, thus grasped, presents the squeegee to the surface being cleaned substantially as an extension of the arm, rather than perpendicular to the arm as with a conventional squeegee having a handle perpendicular to the blades. The contoured handgrip of the handle 62 facilitates applying considerable transverse force to the squeegee without the hand slipping from the handle.

While the principles of the invention have now been made clear in the foregoing illustrative embodiment, there will be immediately obvious to those skilled in the art many modifications of structure, arrangement, proportions, the elements, material and components used in the practice of the invention, and otherwise, which are particularly adapted for specific environments and operating requirements without departing from those principles. The appended claims are, therefore, intended to cover and embrace any such modifications, within the limits only of the true spirit and scope of the invention.

We claim:

1. A squeegee, comprising:

an elongate handle having a first end and a second end, and a slot defined in the handle, the slot extending longitudinally from end to end of the elongate handle, the slot having an arcuate cross section; and a unitary blade adapted to fit in the slot, the unitary blade having a root portion and a working portion, the root portion having an arcuate cross section conforming to the arcuate cross section of the slot in the elongate handle, the root portion of the blade being received in the arcuate slot and held in the handle by the arcuate slot, the working portion of the blade having an arcuate cross section curved oppositely of the root portion of the blade, the unitary blade thereby defining an S-shaped cross section, the working portion of the blade extending from the slot abaxially of the handle along the length of the handle.

2. The squeegee according to claim 1 wherein the unitary blade includes a first end and a second end, the first end of the elongate handle including a flat surface perpendicular to a longitudinal axis of the elongate handle, the first end of the unitary blade being coplanar with the flat surface, the unitary blade extending longitudinally substantially beyond the second end of the handle, whereby the longitudinally extended blade facilitates cleaning surfaces in tight spaces, and the squeegee can be rested in an upright position on the flat surface of the first end of the elongate handle, the working portion of the unitary blade buttressing the squeegee in such upright position.

3. The squeegee according to claim 1 wherein the elongate handle is a hollow cylindriform structure having an internally disposed chine in which the longitudinally extending slot is defined, and further comprising:

a first end cap closing the first end of the elongate handle, the first end cap having a slot coextensive with the slot in the handle, a first end of the root portion of the unitary blade being received in the slot of the first end cap; and a second end cap closing the second end of the elongate handle, the second end cap having a through slot coextensive with the slot in the handle, the root portion of the unitary blade being received in and extending through the slot of the second end cap, the unitary blade extending longitudinally beyond the second end of the handle, whereby the extended blade facilitates cleaning surfaces in tight spaces.

4. The squeegee according to claim 3 wherein the elongate handle is made of a thermoplastic material.

5. The squeegee according to claim 4 wherein the thermoplastic material is selected from the group consisting of PVC, ABS, polyamide and Santoprene.

6. A squeegee, comprising:

an elongate handle having a slot extending longitudinally therein, the slot having an arcuate cross section;

a unitary blade adapted to fit in the slot, the unitary blade having a root portion received in and held by the slot, and a working portion extending from the slot along the handle;

a first end cap at one end of the elongate handle, the first end cap having a slot coextensive with the slot in the handle, an end of the unitary blade being received in the slot of the first end cap; and a second end cap at an end of the elongate handle opposite the one end, the second end cap having a slot coextensive with the slot in the handle, the unitary blade being received in the slot of the second end cap, an end surface of the first end cap being perpendicular to a longitudinal axis of the elongate handle, the end of the unitary blade being coplanar with the end surface of the first end cap, whereby the squeegee can be rested in an upright position on the end surface of the first end cap, the working portion of the unitary blade buttressing the squeegee in such upright position.

7. A squeegee, comprising:

an elongate handle having a slot extending longitudinally therein, the slot having an arcuate cross section; and a unitary blade adapted to fit in the slot, the unitary blade having a root portion received in and held by the slot, and a working portion extending from the slot along the handle, the root and working portions of the unitary blade being of different hardness, the root portion being relatively inflexible and the working portion being relatively flexible, each with respect to the other.

8. The squeegee according to claim 7 wherein the unitary blade extends longitudinally beyond an end of the handle, whereby the extended blade facilitates cleaning surfaces in tight spaces.

9. The squeegee according to claim 7 wherein the unitary blade is coextruded from a thermoplastic material.

10. The squeegee according to claim 9 wherein the thermoplastic material is selected from the group consisting of PVC, polyamide and Santoprene.

11. The squeegee according to claim 9 wherein the thermoplastic material is PVC.

12. The squeegee according to claim 9 wherein the root portion of the unitary blade is formed from PVC 80 shore D rigid durometer, and the working portion of the unitary blade is formed from PVC 65 shore A soft durometer.

13. The squeegee according to claim 7 wherein the root portion of the unitary blade is of arcuate cross section having a curvature corresponding with the cross section of the longitudinal slot.

14. The squeegee according to claim 13 wherein the working portion of the unitary blade is of arcuate cross section.

15. The squeegee according to claim 13 wherein the unitary blade is of S-shape cross section.

16. The squeegee according to claim 7 comprising an end cap at one end of the elongate handle, the end cap having a slot coextensive with the slot in the handle, an end of the unitary blade being received in the slot of the end cap.

17. The squeegee according to claim 16 wherein the slot of the end cap extends through the end cap and the unitary blade extends through the slot of the end cap longitudinally beyond the end of the handle, whereby the extended blade facilitates cleaning surfaces in tight spaces.

18. The squeegee according to claim 16 comprising a second end cap at an end of the elongate handle opposite the one end, the second end cap having a slot coextensive with the slot in the handle, the unitary blade being received in the slot of the second end cap.

19. The squeegee according to claim 18 wherein an end surface of the second end cap is perpendicular to a longitudinal axis of the elongate handle, an end of the unitary blade being coplanar with the end surface of the second end cap, whereby the squeegee can be rested in an upright position on the end surface of the second end cap, the working portion of the unitary blade buttressing the squeegee in such upright position.

20. The squeegee according to claim 7 wherein the elongate handle includes a contoured portion comprising depressions in the handle shaped to receive the thumb and fingers of a hand gripping the handle.

21. A squeegee, comprising:

an elongate handle having a slot extending longitudinally therein, the slot having an arcuate cross section; and a unitary blade adapted to fit in the slot, the unitary blade having a root portion received in and held by the slot, and a working portion extending from the slot along the handle;

the elongate handle being a hollow cylinder having an internal chine in which the slot is formed; and end caps closing either end of the hollow cylinder to form an air space inside the handle so that the squeegee floats on water.

22. A squeegee, comprising:

an elongate handle having a slot extending longitudinally therein, the slot having an arcuate cross section;

a unitary blade adapted to fit in the slot, the unitary blade having a root portion received in and held by the slot, and a working portion extending from the slot along the handle;

a second longitudinal slot formed in the elongate handle spaced apart from and parallel with the first slot, the second slot having an arcuate cross section; and a second unitary blade adapted to fit in the second slot and having a root portion received in the second slot and a working portion extending from the second slot along the handle parallel with the working portion of the first unitary blade.

23. A squeegee, comprising:

an elongate hollow cylindrical handle having first and second ends, a chine extending interiorly the length of the handle, an arcuate slot formed in the chine and extending the length thereof, the slot opening exteriorly of the handle;

first and second end caps closing, respectively, the first and second ends of the handle, the end caps each having an arcuate slot therethrough coextensive with the arcuate slot of the handle; and a unitary blade of S-shape cross section adapted to fit in the arcuate slot of the elongate handle, the unitary blade having a root portion held in the arcuate slot and a working portion extending abaxially of the handle from the slot, the unitary blade being coextruded from a thermoplastic material, the root and the working portions of the unitary blade being of different hardness, the root portion being relatively stiff and the working portion being relatively flexible, each with respect to the other, the root portion of the unitary blade extending through the arcuate slot of the first end cap, the unitary blade extending longitudinally beyond the first end cap whereby the extended unitary blade facilitates cleaning surfaces in tight spaces, the second end cap having a planar end surface perpendicular to a longitudinal axis of the elongate handle, an end of the unitary blade being coplanar with the planar end surface of the second end cap, whereby the squeegee can be rested in an upright position on a flat surface, the abaxially extending working portion of the unitary blade buttressing the squeegee in such upright position.

24. A squeegee comprising:

an elongate tubular handle having a first end and a second end;

a groove extending lengthwise from end to end of the tubular handle; and an elongate blade received in the groove, the blade having a first end substantially aligned with the first end of the handle and a second end protruding lengthwise a predetermined distance beyond the second end of the handle, the blade being integrally formed of a first portion composed of a substantially rigid material inserted into the groove and a second portion composed of a resilient material protruding from the groove to resiliently contact and conform to a surface to be cleaned by the squeegee.

25. A squeegee according to claim 24 in which the blade is formed by coextrusion of polymeric materials of different hardness.

26. A squeegee comprising:

an elongate tubular handle having a first end and a second end;

a groove extending lengthwise from end to end of the tubular handle; and an elongate blade received in the groove, the blade being formed in a shallow S-shaped cross section, the groove being formed with parallel curved sidewalls conforming to the curvature of a portion of the width of the blade, the blade portion and the parallel curved sidewalls of the groove forming an interference fit to retain the blade in the groove, the elongate blade having a first end substantially aligned with the first end of the handle and a second end protruding lengthwise a predetermined distance beyond the second end of the handle to allow insertion of the protruding portion of the blade into corners when the squeegee is in use and facilitating its storage by standing the squeegee on said first ends.

27. A squeegee comprising:

an elongate tubular handle having a first end and a second end;

a groove extending lengthwise from end to end of the tubular handle; and an elongate blade received in the groove, the blade having a first end substantially aligned with the first end of the handle and a second end protruding lengthwise a predetermined distance beyond the second end of the handle, the blade being integrally formed in a shallow S-shaped cross section of a first portion composed of a substantially rigid material inserted into the groove and a second portion composed of a resilient material protruding from the groove to resiliently contact and conform to a surface to be cleaned by the squeegee, the groove being formed with parallel curved sidewalls conforming to the curvature of the first portion of the width of the blade.

28. A squeegee comprising:

a handle consisting of a straight elongate cylindrical member having a first end and a second end;

a pair of parallel, closely spaced-apart channels extending lengthwise from end to end of the handle; and a pair of elongate blade members, each having a rigid base portion received in one of the channels and a flexible portion protruding therefrom for wiping a surface, each of the blade members having a shallow S-shaped cross section and each channel having parallel curved sidewalls conforming to a curvature of the base portion of the blade member received therein.

29. A squeegee comprising:

a handle consisting of a straight elongate cylindrical member having a first end and a second end;

a pair of parallel, closely spaced-apart channels extending lengthwise from end to end of the handle; and a pair of elongate blade members, each having a rigid base portion received in one of the channels and a flexible portion protruding therefrom for wiping a surface, each blade member having a first end substantially aligned with the first end of the handle and a second end protruding lengthwise a predetermined distance beyond the second end of the handle.

* * * * *